US005185597A

United States Patent [19]

Pappas et al.

[11] Patent Number: 5,185,597

[45] Date of Patent: Feb. 9, 1993

[54] SPRITE CURSOR WITH EDGE EXTENSION AND CLIPPING

[75] Inventors: James L. Pappas, Leominster; Larry D. Seiler, Boylston; Robert C. Rose, Hudson, all of Mass.

[73] Assignee: Digital Equipment Corporation, Maynard, Mass.

[21] Appl. No.: 630,384

[22] Filed: Dec. 18, 1990

Related U.S. Application Data

[63] Continuation of Ser. No. 213,197, Jun. 29, 1988, abandoned.

[51] Int. Cl.[5] ..... G09G 5/08

[52] U.S. Cl. ..... 340/709; 340/721

[58] Field of Search ..... 340/706, 709, 710, 721, 340/724

[56] References Cited

U.S. PATENT DOCUMENTS

| | | | |
|---|---|---|---|
| 3,911,419 | 10/1975 | Bates et al. | 340/709 |
| 4,454,507 | 6/1984 | Srinivasan et al. | 340/709 |
| 4,545,070 | 10/1985 | Miyagawa et al. | 382/48 |
| 4,642,790 | 2/1987 | Minshull et al. | 340/724 |
| 4,670,752 | 6/1987 | Marcoux | 340/721 |
| 4,710,767 | 12/1987 | Sciacero et al. | 340/799 |

*Primary Examiner*—Alvin E. Oberley
*Assistant Examiner*—Richard Hjerpe
*Attorney, Agent, or Firm*—Cesari and McKenna

[57] ABSTRACT

A circuit for generating an N by M pixel sprite cursor having edge extension features which are clipped to only appear in preselected windows on a video display. The circuit provides edge extension by extending the pattern appearing in the pixels located along the four edges of the sprite cursor towards the corresponding boundaries of the display. The circuit clips the cursor to preselected windows by determining on a pixel-by pixel basis which window owns the pixel to be displayed and whether the window will permit a cursor to appear in it.

11 Claims, 6 Drawing Sheets

SPRITE CURSOR WITH EDGE EXTENSION AND CLIPPING

RELATED APPLICATIONS

This application is a continuation of copending application Ser. No. 07/213,197, filed on June 29, 1988, now abandoned.

This invention is related to the following applications, all of which are assigned to the assignee of the present invention and were filed in the names of the inventors of the present invention:

Apparatus and Method for Specifying Windows with Priority Ordered Rectangles, in a Computer Video Graphics System, Ser. No. 205,030, filed June 13, 1988.

Semaphore Controlled Video Chip Loading in a Computer Video Graphics System, Ser. No. 206,194, filed June 13, 1988.

Datapath Chip Test Architecture, Ser. No. 206,203, filed June 13, 1988.

Window Dependent Pixel Datatypes in a Computer Video Graphics System, Ser. No. 211,778, filed June 13, 1988.

Pixel Data Formatting, Ser. No. 212,819 filed June 27, 1988.

Window-Dependent Buffer Selection, Ser. No. 212,590, filed on even date herewith.

Extendable-size Color Look Up Table for Computer Graphics System, Ser. No. 212,834, filed on even date herewith.

FIELD OF THE INVENTION

This invention relates generally to the field of computer video work stations and, more particularly, to a circuit for generating a sprite cursor to be displayed on a video terminal.

BACKGROUND OF THE INVENTION

Interactive computer graphics is the designation given to an area of computer graphics in which the user of the computer can dynamically control the content, format, size and colors of the picture on a computer video display. These capabilities have had particular relevance in a growing list of uses such as computer-aided design (CAD), simulation, process control and electronic publication, to name a few. While applications of interactive computer graphics to these uses have developed, display capabilities on existing computer graphics systems have become inadequate as users have come to expect and demand greater sophistication and speed from the systems. A good example of a display capability that has fallen victim to these increasing user expectations is the display cursor available on previously existing systems.

The cursor is an indicator which appears on the display screen identifying to the user where he is in the image. In other words, it appears over the image generated by a user application program and indicates the location in the image about which the user can either request further information or modify the image in some way. The cursor may be any of a variety of shapes ranging from the ordinary blinking rectangle commonly found on terminals to other more complicated shapes such as an arrow or a pair of intersecting lines crossing the display screen to form a hairline cursor.

Generally, a "mouse" or a "joy stick" determines the cursor's position on the display. These devices are mechanical controls which translate physical movement of the device into signals which control the movement of the cursor on the display. Thus, by physically moving the device, the user can move the cursor to any desired position on the image.

To understand how the cursor is generated it is necessary to have a basic understanding about the source of the image appearing on the display. Generally, the image display system on a video terminal utilizes a frame buffer to store information which is to be written onto the display. The frame buffer, also referred to as a bit map, is essentially a memory array wherein each location in the array is identified by both its column and its row position in the array. Located at each address in the memory array is information about the signal which will be sent to a corresponding location on the display. Thus, in a typical color display system which generates images by using combinations of the three basic colors, namely, red, green and blue, the information at an address in the frame buffer specifies the intensity of each of the three basic colors that will appear at the corresponding location on the display. The stored information must typically be a multi-bit word in order to be capable of representing more than two colors. Thus, for example, by using a three bit wide word, a maximum of $2^3$ (or 8) different colors are available. In this case the frame buffer is essentially a three-plane memory in which each of the three bits is stored at the same address in a different, corresponding plane of the memory.

Achieving an acceptable image on the display requires that the image from the frame buffer be written onto the display at a rate of approximately 60 times per second, sometimes referred to as the refresh rate. This refresh rate is necessary to generate an image which appears continuous. If the rate is much lower than this, the user will perceive the successive writing of contents of the frame buffer to the screen as a disturbing flicker of the resulting image.

Historically, the cursor has been generated by software and then added to the contents of the frame buffer, replacing or modifying the image information in the buffer address positions where the cursor is to appear. Thus, when the contents of the frame buffer are written onto the display during a refresh cycle, the display shows the cursor in the desired location. Generally, several different approaches have been employed to accomplish this.

According to one approach, the cursor information is written into the frame buffer at the desired address locations, completely replacing the image information which was previously contained at those locations. The displaced image information could not simply be discarded, however, because when the cursor is moved to a different location, the image which was hidden by the cursor must reappear. To avoid the time-consuming task of having to recompute the image information, the displaced image information is simply stored in a temporary memory location until required. Thus, when the cursor is moved, the information describing the image which lay beneath the cursor is retrieved from the temporary memory and written into the appropriate frame buffer locations and the newly displaced image information in the frame buffer is transferred to the temporary memory for later retrieval. The problem with this approach, however, is that considerable computational overhead and delay is associated with this transferring process and the accounting which must necessarily accompany it.

Furthermore, modifying portions of the displayed image which are obscured by the cursor presents added difficulties. Before an underlying image which is partially obscured by the cursor can be changed, the cursor must be moved. If it is not moved, changes to the image may not be recorded for the obscured regions. Thus, when the cursor is moved after the displayed image has been changed, a "hole" may exist in the image where the cursor was located. Moving the cursor out of the way while changes to the image are implemented is typically the responsibility of the applications program. In other words, the applications program must determine whether the cursor obscures an area which is to be changed and, if it does, the program must move the cursor, retrieve the underlying image data from the temporary memory, modify the image as requested and then, after saving the underlying image data back to the temporary memory, replace the cursor. Understandably, this increases the time it takes to update the image and it requires committing greater computational resources to maintaining the cursor.

The second approach avoids some of these problems by preserving the image information in the frame buffer. According to this approach, one plane of the frame buffer, which may be designated a cursor plane, is dedicated to storing a bit which specifies whether a cursor will appear at that location. The basic image information describing the image is stored in the remaining planes and need not be changed under this approach. When the bit in the cursor plane indicates that a cursor appears at that location, the display responds by displaying a preselected color assigned to the cursor. Although the back and forth transferring of image information to a temporary memory is avoided, this approach presents another serious shortcoming. Dedicating one plane of the frame buffer to the cursor information, cuts the range of colors available on the display to one half the total actual capacity of the frame buffer.

There is an alternative approach which also preserves the information in the frame buffer sometimes referred to as XORing. Instead of dedicating planes of the frame buffer to holding the cursor information, the multi-bit word in the buffer at those locations where a cursor is to appear is simply complemented. As a rule, the complement of the word will generate a color on the display which is different from the color of the underlying image thereby indicating the location of the cursor. Although this approach yields an efficient use of computational and memory resources in the computer, its main disadvantage is that it is visually quite unacceptable. On color displays it typically generates a multicolored cursor, the colors of which change as the cursor is moved over the image.

All of the above-described approaches to the software generation of cursors tend to share another set of problems which limit their appeal. They involve writing cursor information to the frame buffer which takes time and consumes the computational resources of a central processor. Consequently, the time and resources dedicated to supporting the cursor is not available to support the applications program which is generating the underlying image on the display. To prevent cursor support from excessively compromising the quality of the primary image on the display, a limit is typically placed on how frequently the cursor information in the frame buffer will be updated. Instead of changing the cursor information on the frame buffer prior to every refresh cycle, it is updated much less frequently. Placing such a limit on the frequency of update, however, makes the cursor appear to be sluggish and unable to respond smoothly to commands demanding rapid movement across the screen.

When operating in a windowed environment, the limitations of software generated cursors become more significant. A windowed environment is one in which a user may open multiple windows on the display giving him the ability to run a different applications program in each window. Typically, a window occupies only a portion of the display screen and if there is more than one window, it may overlap a lower window such that it occludes a portion of the lower window. The lower window is generally referred to as an inferior window. When the applications program has the task of supporting the cursor, the presence of windows complicates this task. This commonly leads to compromising cursor capability so as not to sacrifice too much of the quality of the images displayed in the windows. Thus, not only does the cursor appear to be sluggish but software generated hairline cursors appear to break apart or "tear" when the user attempts to move it rapidly from one location on the display to another. Such characteristics tend to be visually disconcerting and undesirable.

A hardware generated cursor is an alternative to the software generated cursor. The hardware dedicated to generating the cursor relieves the central processor and the applications program of a significant portion of the responsibility for cursor support. Consequently, the hardware generated cursors generally do not exhibit the sluggishness and tearing that characterizes the software generated cursors. On the other hand, they also tend to suffer from other inadequacies. For example, the only available hairline cursors are simple, single line cross hairs, which are usually constructed of a single color. If the selected color is the same as the color of the background, the cross hair will disappear when placed over the background. In addition, the available hairline cursors lack versatility. Sometimes the simple cross hair is not the desired or even the optimum choice for the user's particular application. An array of multicolored crosshairs may provide more effective visual display of the cursor with regard to the particular application.

Another shortcoming is that a hardware generated hairline cursor used in one window tends to interfere with applications in other windows. Typically the hairline cursor extends across the entire display. Thus, even though the user may only wish to use a hairline cursor in one particular window, the hairlines will cross other windows which are displaying other applications. This tends to be distracting since on some occasions it may obscure important details in other windows and, on other occasions, it tends to shift focus away from the window of immediate importance to the user.

SUMMARY OF THE INVENTION

The present invention generates a highly responsive and versatile cursor which provides a hairline mode and which does not interfere with applications displayed in other windows. A control circuit embodying the invention assumes responsibility for generating a cursor signal which selects either a transparent mode, in which image data from a frame buffer is allowed to pass to a raster display, or a cursor mode, in which signals from a preselected signal sources are sent to the display to produce the desired cursor pattern. In accordance with the invention, the control circuit produces a sprite cursor which has edge extension features and which can be clipped to appear only in preselected windows.

The sprite cursor is an N by M array of pixels which will appear at a location on the raster display, i.e. $X_{cursor}$, $Y_{cursor}$, specified by a user. When the edge extension feature is fully activated, the control circuit extends the pattern appearing in the pixels located along the four edges of the sprite cursor toward a corresponding boundary of the display. Thus, for example, the pattern in the top row of the sprite cursor array is reproduced on each scan line located above the sprite cursor and the pattern in the left-most column of the sprite cursor array is reproduced at each pixel located on the corresponding scan line to the left of the sprite cursor. The patterns in the bottom row and the right-most column of the sprite cursor array are extended in a similar way.

When the clipping mode is activated, the circuit causes the cursor, including the extended edges, to be displayed only within designated windows and not within non-designated windows. The circuit accomplishes this by determining on a pixel-by-pixel basis which window owns the pixel and by examining a cursor flag which indicates whether a cursor may appear in the window owning the pixel. If the flag indicates that a cursor should not appear, the control circuit forces the selection of the transparent mode for the pixel.

BRIEF DESCRIPTION OF THE DRAWINGS

The invention is pointed out with particularity in the appended claims. The above, and further, advantages and aspects of this invention may be understood by referring to the following detailed description taken in conjunction with the accompanying drawings, in which:

DETAILED DESCRIPTION OF AN ILLUSTRATIVE EMBODIMENT

Figure 1:
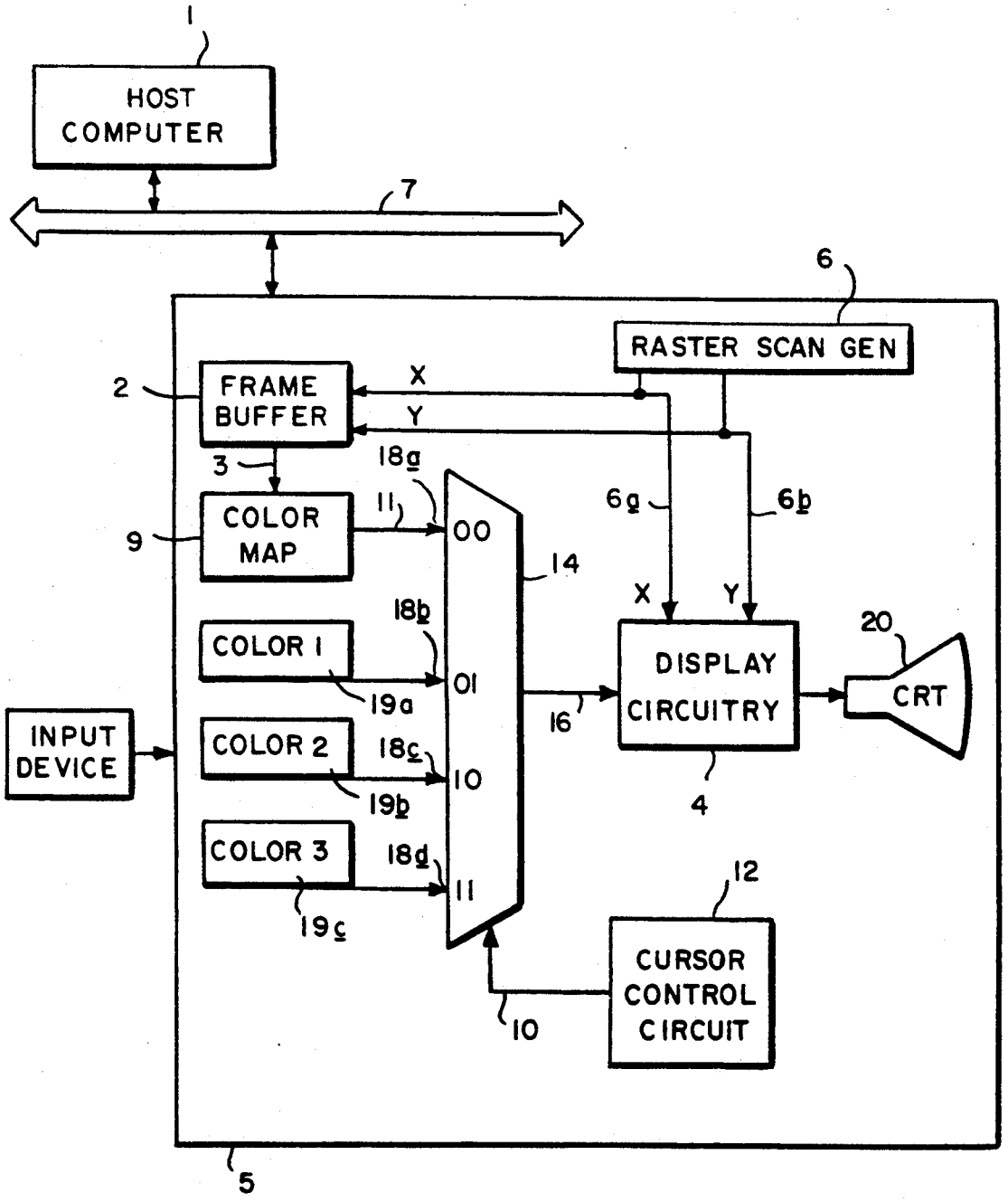
FIG. 1 is a block diagram of an image display system which embodies the invention.

FIG. 1 schematically illustrates a computer video graphics system which employs the invention. The system comprises a host computer 1 which serves as the central data processing unit for the system and a video work station 5 which communicates with the host computer 1 over a main bus 7. The video work station 5 receives data and graphics commands from the host computer 1 and processes the data for visual display.

The video work station includes a frame buffer 2 which is a memory array that receives and stores information to be presented on a video display 4. A raster scan generator 6 generates x- and y- address signals **6*a* and 6*b*, identifying locations in the frame buffer 2 which contain image information. The frame buffer 2 produces a digital frame buffer signal 3 which is sent to a color map 9. The color map 9 converts the frame buffer signal 3 into an image signal 11 which is then sent to an input 18*a* of a display multiplexer 14. The display multiplexer includes other inputs 18*b–d* which receive signals from preselected signal sources 19*a–c*. In accordance with the invention, a cursor control circuit 12 produces a cursor signal 10 which directs the display multiplexer 14 to select one of the display multiplexer inputs 18*a–d*. The display multiplexer 14 switches the signal on the selected input onto its output 16 and passes it to a video display circuit 4. The video display circuit 4, which includes parallel-to-serial converters and video digital-to-analog circuits (not shown in the figures), converts the signal from the display multiplexer 14 to a form which can be displayed on a video display 20. The x- and y- address signals 6*a* and 6*b* control the video display circuit 4 so that the image information from a particular x-y location in the frame buffer 2 is sent to the corresponding location on the video display 20**.

In the illustrated embodiment, the video display 20 is a cathode ray tube (CRT) having three electron guns, one for each of the basic colors, namely red, green and blue. The raster scan generator 6 synchronously scans the electron beams from the three guns back and forth across the face of the CRT thereby producing an array of horizontal lines, each line comprising a sequence of dots or picture elements, otherwise referred to as pixels. Each pixel in the array has a unique x-y location on the display, $X_{pixel}$, $Y_{scan}$, where $Y_{scan}$ is the number of the horizontal scan line on which the pixel is located and $X_{pixel}$ is the location of the pixel along the scan line. The color and intensity of each pixel on the display is determined by the information stored in a corresponding location in the frame buffer 2.

The cursor signal 12, which controls the multiplexer 14, is two bits wide giving it the capacity to represent four different states, namely 00, 01, 10 and 11. Each state causes the display multiplexer 14 to select a corresponding input **18*a–d*. In this embodiment, the 00 state is also referred to as the transparent mode since it causes the multiplexer 14 to pass the image signal 11 to the display 20 thereby allowing the stored image from the buffer 2 to appear. The three remaining states represent cursor modes. They replace the image signal 11 with a signal from one of the preselected signal sources 19*a–c* to generate an image of the cursor on the display. Clearly, a maximum of three different colors, one for each of the three preselected signal sources 19*a–c*, is available from which to generate a cursor. Of course, using a cursor signal 10 having more bits and an appropriately larger display multiplexer 14** would expand this capacity, thereby allowing the system to display the cursor using a significantly larger range of colors.

Figure 2:
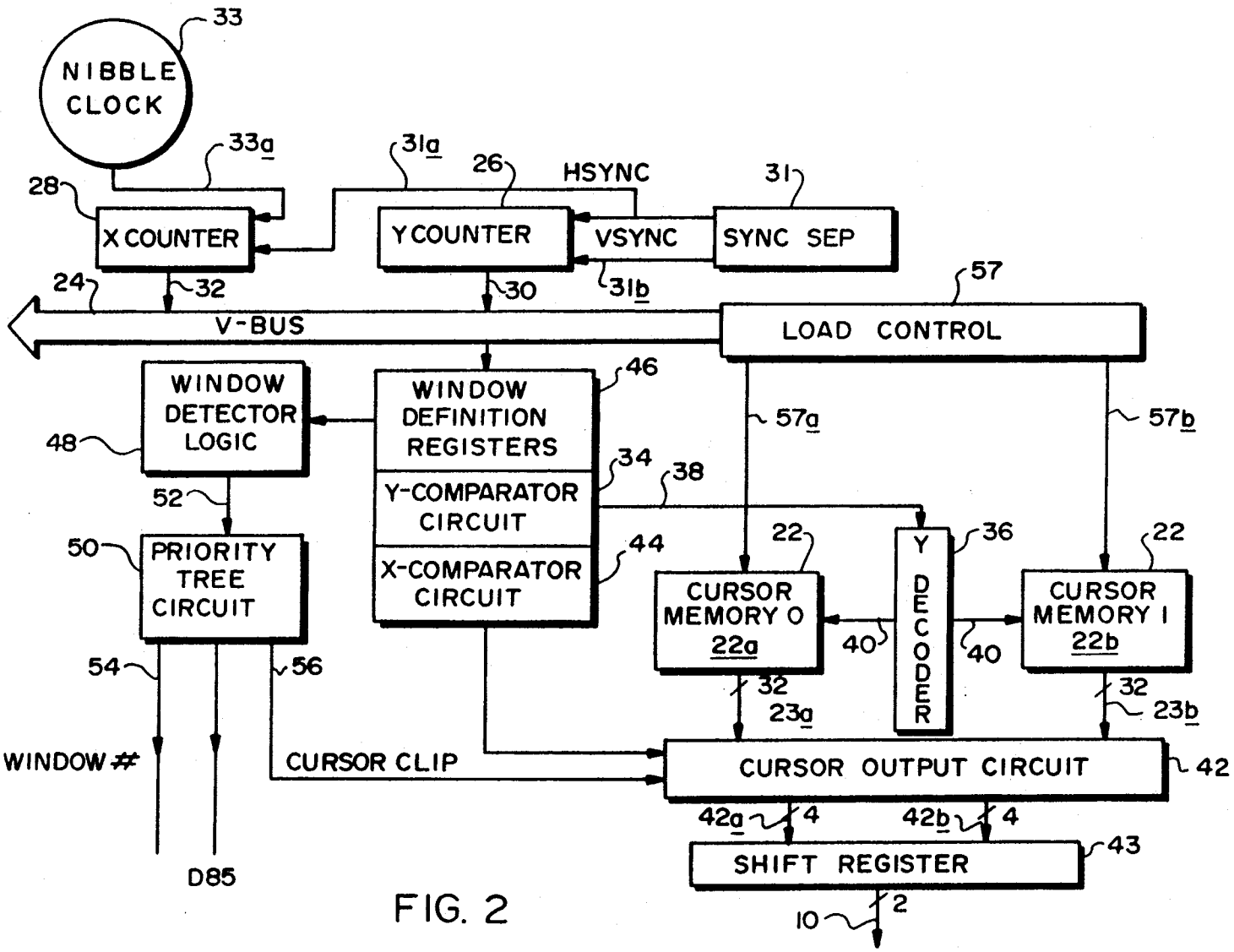
FIG. 2 is a block diagram of the cursor control circuit shown in the FIG. 1.

The cursor control circuit 12, illustrated in greater detail in FIG. 2, determines both the colors and the shapes of the cursor to be displayed. The cursor, which has a preprogrammed shape using an N×M array of pixels, is commonly referred to as a sprite cursor. Sprite cursor information or data, in the form of an array of two bit wide words stored in a cursor memory 22, is used to generate the cursor signal 10. The cursor memory 22 is an AXBX2 bit memory array having a first plane **22*a* and a second plane 22*b*. The first plane 22*a* stores the least significant bits of the words and the second plane 22*b* stores, at corresponding locations, the most significant bits of the words. In this embodiment, each plane 22*a* and 22*b* is a 32×32 bit memory array capable of representing a 32×32 pixel sprite cursor on the display 20**.

The cursor circuit 12 receives count signals from a Y-counter 26 and an X-counter 28 over a v-bus 24. The Y-counter 26 generates a first count signal 30 which it increments each time that it senses a horizontal sync (HSYNC) pulse 31*a* from a sync separator 31, indicating that the raster scan has moved back to the beginning of the next scan line and a new scan line is about to begin, and it resets to zero each time it senses a vertical retrace (VSYNC) signal 31*b* from the sync separator 31, indicating that the raster scan has moved back to the top of the screen to begin a new refresh cycle. Thus, the first count signal 30 indicates the number of the raster scan line currently being sent to the display 20, i.e. $Y_{scan}$. In a similar way, the X-counter 28 generates a second count signal 32 which it increments each time it senses a clock pulse 33*a* from a nibble clock 33, indicating that another pixel or group of pixels is being processed by the circuitry, and it resets to zero each time it senses the HSYNC pulse. In other words, the second count signal 32 indicates the x-location on the scan line of the pixels being displayed, i.e $X_{position}$.

The cursor control circuit 12 processes the first and second count signals 30 and 32 to produce the cursor signal 10. As illustrated in FIG. 2, the control circuit 12 includes a Y-comparator circuit 34 and a Y-decoder 36. The Y-comparator circuit 34 monitors $Y_{scan}$, compares it to the y-location of the cursor, namely $Y_{cursor}$, and generates a y-comparison signal 38 that is sent to a Y-decoder 36. The Y-decoder 36 decodes the y-comparison signal 38 to produce a row address signal 40, identifying a row in the cursor memory 22. The cursor memory 22 responds to the row address signal 40 by passing the stored contents of the memory located at the designated row to a cursor output circuit 42 over its two outputs 23*a* and 23*b*. Each output 23*a* and 23*b* is 32 bits wide corresponding to the 32 memory locations in each phase of each row of the cursor memory 22.

The control circuit 22 also includes an X-comparator circuit 44 which controls the cursor output circuit 42. The X-comparator circuit 44 monitors $X_{position}$, compares it to the x-location of the cursor, namely $X_{cursor}$, and indicates when the raster scan has reached the x-location of the cursor. Based partially on the output of the X-comparator 44, the cursor output circuit 42 then produces two 4-pixel cursor output signals 42*a* and 42*b*, one for each plane of the cursor memory 22*a* and 22*b*. The two 4-pixel cursor output signals 42*a* and 42*b* are then converted from parallel to serial form by a shift register 43 to produce the cursor signal 10. For each pixel to be displayed on the display 20, the two-bit wide, cursor signal 10 causes the display multiplexer 14 (see FIG. 1) to select either the transparent mode or a mode corresponding to the stored information in the row of cursor memory 22 designated by the Y-decoder 36.

Figure 3:
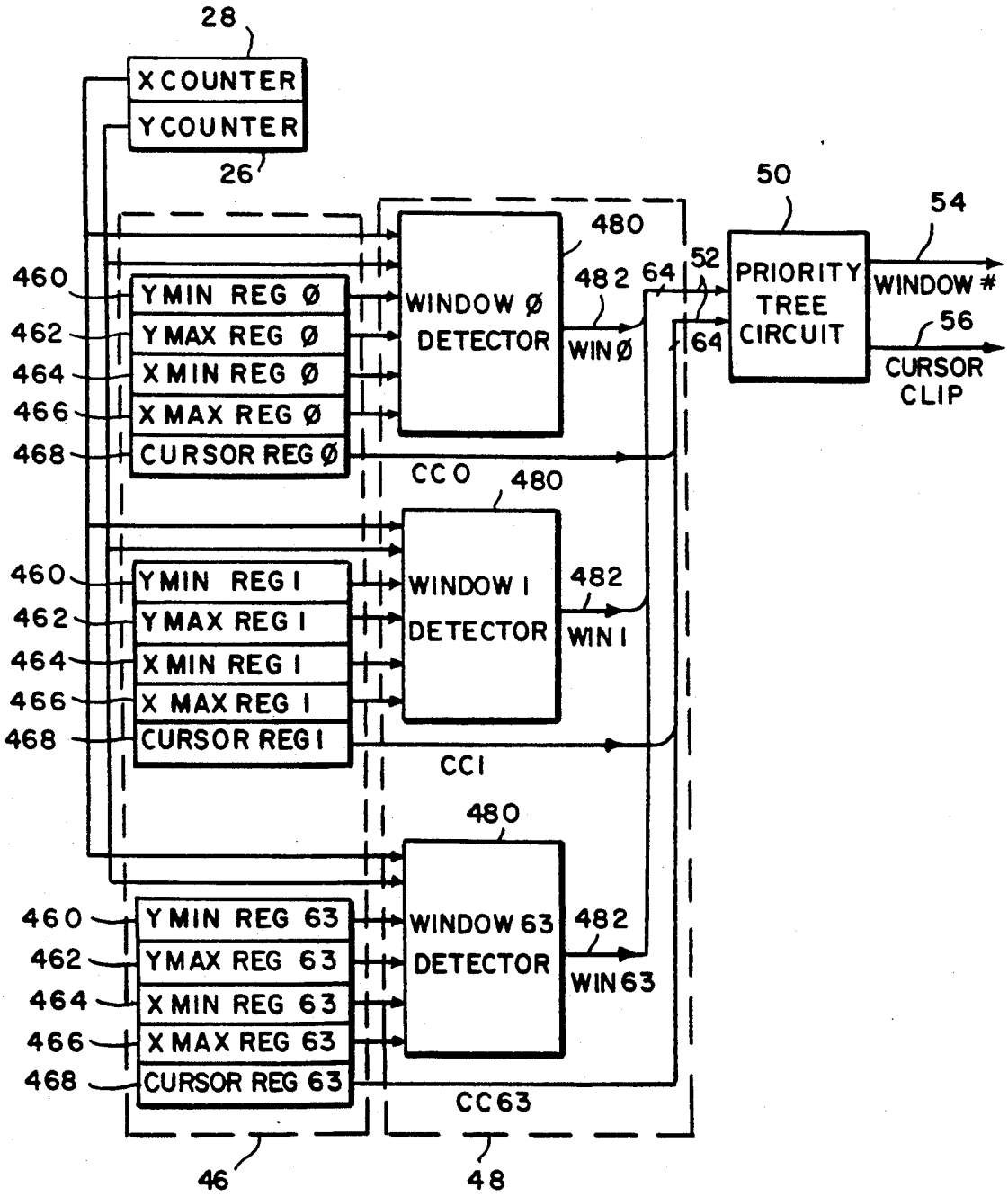
FIG. 3 is a block diagram of the part of the circuit shown in FIG. 2 which produces a cursor clip signal.

Also in accordance with the invention, the cursor control circuit 12 clips the cursor so that it appears only in designated windows. The portion of the cursor control circuit 12 which implements this function comprises a set of window definition registers 46, window detector logic circuits 48 and a priority tree circuit 50. The window definition registers 46 include memory which stores the specifications for each of the windows which have been opened by the user and which stores cursor flags indicating whether a cursor may appear in the window. As shown in FIG. 3, the window definition registers 46 include, for each window which the system can support, a set of registers comprising a $Y_{min}$ register 460, a $Y_{max}$ register 462, an $X_{min}$ register 464, an $X_{max}$ register 466 and a cursor flag register 468. $Y_{min}$ and $Y_{max}$ specify the left and right boundaries of the window, respectively; and, $X_{min}$ and $X_{max}$ specify the top and bottom boundaries of the window. In one embodiment, the system supports 64 windows; therefore, there are 64 such sets of registers, one set for each window.

The registers 46 provide the window information to the window detector logic 48, which also communicates with the v-bus 24 from which the detector logic 48 receives the location of the pixels to be displayed by the raster scan, namely $X_{pixel}$, $Y_{scan}$. The detector logic 48 includes a window detector 480 for each of the windows supported by the system. The window detector 480 compares the $X_{pixel}$, $Y_{scan}$ data to the window specifications from the corresponding set of registers in the window definition registers 46 and generates an WIN signal 482 indicating whether the displayed pixel located at $X_{pixel}$, $Y_{scan}$ falls within the corresponding window. The detector 480 uses equals comparisons to determine the location of the displayed pixel relative to the window boundaries. In other words, as the $X_{pixel}$ increments in synchronization with the scan, the detector 480 first senses and stores the occurrence of an equality between $X_{pixel}$ and $X_{min}$, indicating that the pixel has entered the window through the left boundary, and then, as the scan proceeds, the detector 480 senses and stores the occurence of an equality between $X_{pixel}$ and $X_{max}$, indicating that the pixel has left the window through the right boundary. In a similar way, the detector 480 determines whether the $Y_{scan}$ is within the region defined by the top and bottom boundaries of the window.

WIN signals 482 from each of the 63 detectors 480 along with the corresponding flags from the cursor registers 468 make up the detector signal 52 which is passed to the priority tree circuit 50. The priority tree circuit 50 then determines which window controls or "owns" the pixel to be displayed. Because it may be desirable to have windows overlap, pixels may fall within the boundaries of more than one window. Since it is preferable that information associated with only one window be sent to a particular pixel location on the display, the circuit determines which window (or, in other words, which application program corresponding to the window) will supply the information controlling the pixel on the display. To determine which window owns a pixel, the priority tree circuit 50 implements a preselected set of rules defining the relative priorities of the windows. Accordingly, when a pixel falls within the boundaries of several windows, the window having the highest priority owns the pixel. In the described embodiment, the system is capable of displaying 64 windows numbered zero to 63 and the preselected set of rules controlling the priority tree circuit 50 is simply that the window with the lowest number has priority or "owns" the pixel. In addition to producing a window identifier signal 54 identifying which window owns the pixel, the priority circuit 50 also produces a cursor clip signal 56 corresponding to the cursor flag for the identified window. The cursor clip signal 56 indicates whether a cursor can appear in the window designated by the identifier signal 54. Thus, for example, a cursor clip signal 56 of one signifies that the window identified by the window identifier signal 54 may display a cursor. And conversely, a cursor clip signal 56 of zero signifies that the identified window 54 may not display a cursor. The output circuit 42 receives the cursor clip signal 56 and responds by forcing the cursor signal 10 to call for the transparent mode for all pixels owned by windows in which the cursor is not meant to appear.

A more detailed description of one embodiment of the Window detector logic circuits 48 and the priority tree circuit 50 is presented in U.S patent application for Window-Dependent Buffer Selection filed on even date herewith and assigned to the assignee hereof. That application is hereby incorporated by reference.

Also shown in FIG. 2 is a load control circuit 57. The load control circuit 57 loads data into the above-mentioned registers over the V-bus 24 and into the cursor memory 22 over input lines 57*a* and 57*b* during the period of the vertical retrace. In this embodiment, the data is loaded sequentially into the respective registers. This is done by passing a token signal (not shown) among the registers to be loaded. While the token is in the possession of a particular set of registers, data for those registers will be loaded. When the loading is complete, the token is passed to the next set of registers and the appropriate data for those registers is loaded. This continues until all registers and memory are loaded. Of course, alternative methods of loading the data which are known to those skilled in the art may also be used and would also fall within the scope of this invention.

The cursor output circuit 42 supports at least five functions, namely left, right, top and bottom edge extension and cursor clip, each of which can be activated with the appropriate commands. The detailed operation of the cursor output circuit 42 will be described shortly. Functionally, however, the output circuit 42 performs as follows. If none of the extension functions is activated, the cursor output circuit 42 will produce a transparent mode signal when it is displaying any portion of the image not containing the sprite cursor, thereby permitting the image signal 11 to be sent to the display 4. As soon as the raster scan begins to display pixels which should include the sprite cursor, the output circuit 42 will select one of the other three preselected signal sources 19*a–c* depending upon the information stored in the corresponding row of the cursor memory 22. This causes the 32×32 bit sprite cursor to appear at its intended location.

When an edge extension function is activated, the output circuit 42 essentially extends the corresponding edge of the sprite cursor to the side of the screen indicated by the activated mode. Thus, for example, if the top extension function is activated, the sprite cursor pattern in the first row of cursor memory 22 is reproduced on each scan line between the top of the display and the first row of the sprite cursor. That is, for each scan line above the cursor, the output circuit 42 outputs the first row of the cursor memory 22 starting at the x-location on the scan line corresponding to $X_{cursor}$. The three other functions operate in a similar manner.

Figure 4:
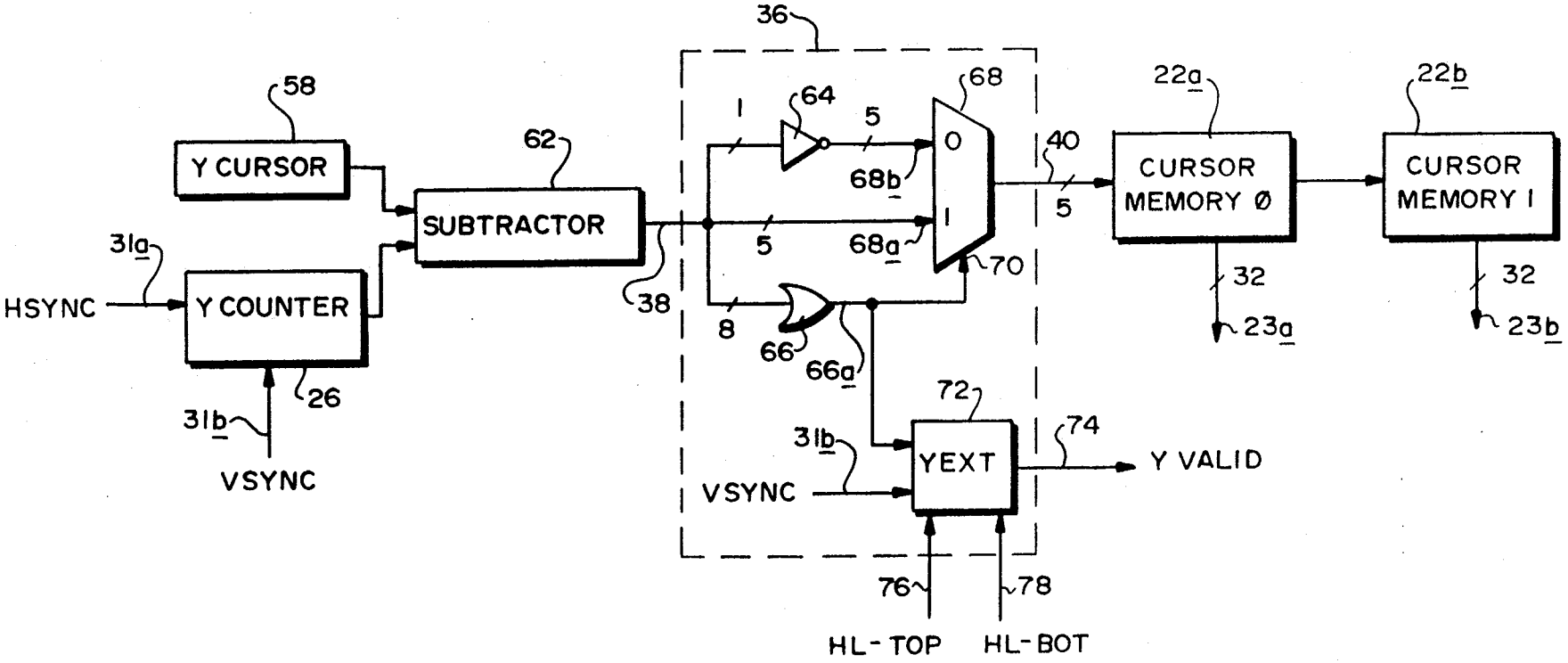
FIG. 4 is a block diagram of the part of the circuit shown in FIG. 2 which generates a row address signal for a cursor memory.

The Y-comparator 34 and the Y-decoder 36 work together to generate a row address signal 40 that satisfies the following rules. For all scan lines above the location of the sprite cursor, the row address signal 40 is the address of first row of the cursor memory 22. For the scan lines which intersect the sprite cursor, the row address signal 40 is the row address of the intersected row of cursor memory 22. And finally, for all scan lines below the $32^{nd}$ line of the sprite cursor, the row address signal is the address of the last row of the cursor memory 22. The circuitry used to accomplish this is shown in FIG. 4 in block diagram form.

As illustrated, a subtractor 62 receives $Y_{scan}$, indicating the scan line being displayed, from the Y-counter 26 and it receives $Y_{cursor}$, indicating the y-location of the cursor, from a y-register 58. The subtractor 62 subtracts $Y_{cursor}$ from $Y_{scan}$ to generate the y-comparison signal 38. In one embodiment, the $Y_{scan}$ is a 12 bit wide signal and the $Y_{cursor}$ is a 13 bit wide signal where the most significant bit, namely the thirteenth bit, is a sign bit indicating whether the number is positive or negative. The resulting y-comparison signal 38 is also a 13 bit wide signal with the most significant bit being the sign bit. If the $Y_{scan}$ is before $Y_{cursor}$, the sign bit of the y-comparison signal 38 will be one, indicating the number is negative.

The Y-decoder 36, which decodes the y-comparison signal 38, includes a first inverter 64, an eight-input OR gate 66 and a first multiplexer 68 having a first signal input 68*a* and a second signal input 68*b*, each consisting of five lines. The first signal input 68*a* of the multiplexer 68 receives the five least significant bits of the y-comparison signal 38. The first inverter 64 receives the most significant bit of the y-comparison signal 38, inverts it and passes the result to each of the five lines of the second signal input 68*b*. The OR gate 66, which controls the state of the first multiplexer 68, performs an OR function on the eight most significant bits of the y-comparison signal 38 and passes the results 66*a* to a control input 70 of the first multiplexer 68. If the control input 70 senses a zero bit, the first multiplexer 68 selects the first signal input 68*a*; whereas, if it senses a one bit, it selects the second input 68*b*. The signal on the selected input of the first multiplexer 68 is passed to the cursor memory 22 as the row address signal 40.

As the raster scan displays successive lines on the display, the above-described Y-decoder 36 produces the following results. When $Y_{scan}$ is above $Y_{cursor}$ on the display, the sign bit of the y-comparison signal 38 is a one and each of the five lines of the second signal input 68*b* receives a zero. Moreover, since the most significant bit of the y-comparison signal 38 is one, the OR gate 66 will instruct the first multiplexer 68 to set the row address signal 40 equal to the five zero bits on the second signal input 68*b*. Thus, for all scan lines above the cursor, the cursor memory 22 outputs the 32-bit contents of the first row of its memory array.

When $Y_{scan}$ reaches $Y_{cursor}$, the sign bit of the y-comparison signal 38 becomes zero, switching the signals on the five lines of the first signal input 68*a* from zero bits to one bits. Indeed, each of the eight most significant bits of the y-comparison signal 38 will equal and remain equal to zero until $Y_{scan}$ reaches $Y_{cursor}$ plus the number of rows in the cursor memory, namely 32. In this range, the five least significant bits of the y-comparison signal 38 identifies the row of the 32×32 bit sprite cursor which is to be displayed on the scan line. Since the eight most significant bits of the y-comparison signal 38 are zero, the output of the OR gate 66 will be zero, forcing the first multiplexer 68 to set the row address signal 40 equal to the five least significant bits of the y-comparison signal 38. In other words, once the scan line has reached the y-location of the cursor, each successive scan line addresses the next row of the cursor memory 22 until all 32 rows have been addressed.

Finally, when $Y_{scan}$ reaches $Y_{cursor}$ plus 32, the sixth bit of the y-comparison signal 38 will change from zero to one. For this scan line and all succeeding scan lines below the displayed sprite cursor, the eight most significant bits of the y-comparison signal 38 will have the following two characteristics. The sign bit will equal zero indicating the y-comparison signal 38 represents a positive number and at least one of the eight most significant bits of the y-comparison signal 38 will equal one. Since the sign bit is zero, the five lines of the first signal input 68*a* will each receive bits having value one. In addition, the output of the OR gate 66 will also be one, forcing the first multiplexer 68 to select the first signal input 68*a*. Therefore, for all scan lines after the sprite cursor, all five bits of the row address signal 40 will equal one, addressing row number 31 of the cursor memory 22.

The Y-decoder 36 also includes a Y-extender circuit 72 which determines whether the top or bottom extension functions are activated. The Y-extender circuit 72 receives the output from the OR gate 66 and produces a Y-valid signal 74. When the output of the OR gate 66 is low, indicating that the raster scan generator is generating scan lines which include the sprite cursor, then the Y-valid signal 74 is high. On the other hand, when the output of the OR gate 66 is high, indicating that the raster scan generator is generating scan lines which are either before or after the sprite cursor, then the Y-valid signal 74 is determined by either the signal on an HL_TOP input 76 or the signal on an HL_BOT input 78, depending upon whether the scan line is before or after the sprite cursor, respectively. A high signal on the HL_TOP input 76 activates the top extension function, and a high signal on the HL_BOT input 78 activates the bottom extension function.

Figure 5:
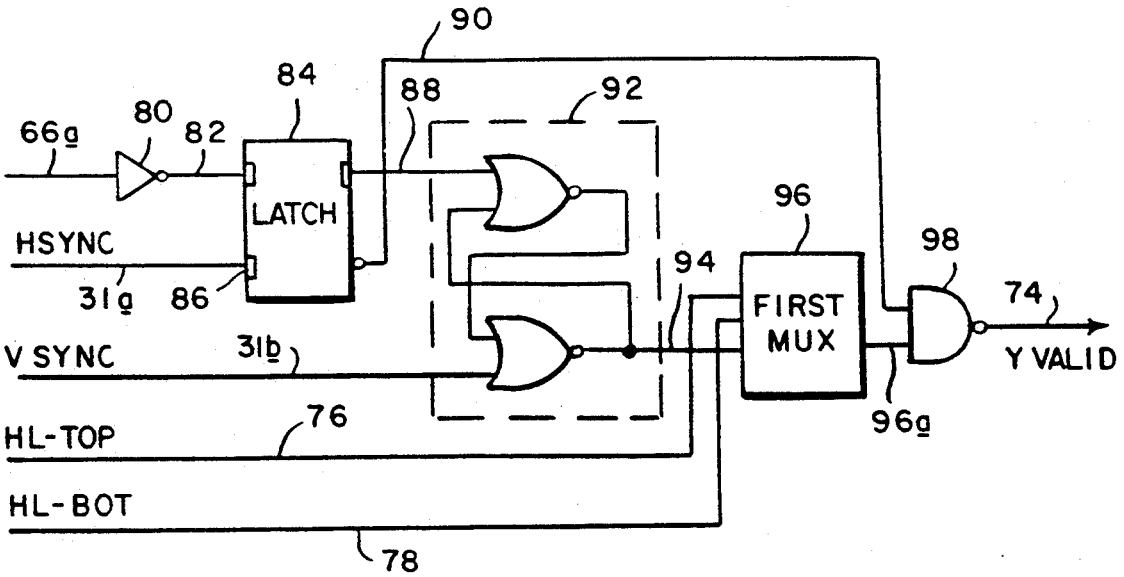
FIG. 5 is a block diagram of the Y-extender circuit shown in FIG. 4.

FIG. 5 is a block diagram of the Y-extender circuit 72. As shown, a second inverter 80 receives the output signal from the OR gate 66 and drives an input 82 of a latch 84. The latch 84 also has a clock input 86 which receives HSYNC pulses; a first output 88, which yields the input signal; and a second output 90, which produces the complement of the input signal. The first output 88 of the latch 84 drives a first flip-flop 92. The first flip-flop 92 generates a first control signal 94 for a two-input inverter-multiplexer 96. One input of the multiplexer 96 is the HL_TOP input 76 and the second input is the HL_BOT input 78. When the first control signal 94 from the flip-flop 92 is low, the multiplexer 96 generates a signal on an output 96*a* which is the complement of the signal on the HL_TOP input 76; whereas, when the first control signal 94 from the flip-flop 92 is high, the multiplexer 96 generates a signal on its output 96*a* which is the complement of the signal on the HL_BOT input 78. The signals on the output 96*a* of the multiplexer 96 and on the second output 90 of the latch 84 are then passed to a NAND gate 98. The NAND gate 98 generates the Y-valid signal 74. Finally, after the end of the last scan line and before the raster scan generator begins a retrace of the display, the VSYNC pulse 31*b* resets the flip-flop 92.

Generally, on the first scan line after the flip-flop 92 has been reset by a VSYNC pulse, the output of the OR gate 66 is high and the flip-flop 92 produces a first control signal 94 which is low. Consequently, the Y-valid signal 74 is equal to the signal on the HL_TOP input 76. When $Y_{scan}$ equals $Y_{cursor}$, the output of the OR gate 66 goes low, causing the flip-flop 92 to change state and setting the second output 90 of the latch 84 to low. This forces the output of the NAND gate 98, i.e. the Y-valid, to high. Finally, when $Y_{scan}$ is greater than $Y_{cursor}$ plus 31, the output of the flip-flop 92 remains high and the signals on the output of the OR gate 66 and on the second output 90 of the latch 84 both go high, setting the Y-valid 74 equal to the signal on the HL_BOT input 78.

Figure 6:
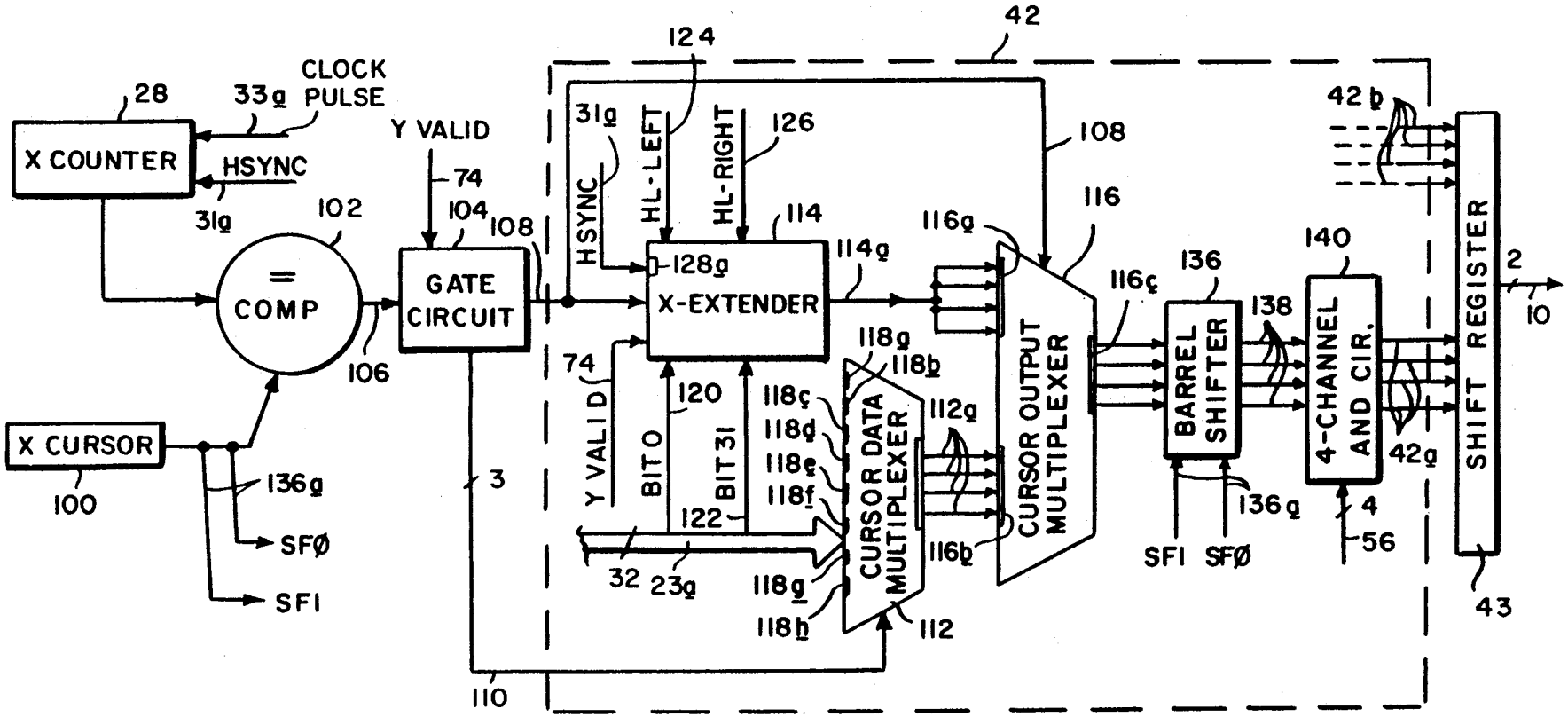
FIG. 6 is a block diagram of the part of the circuit shown in FIG. 2 which processes data from the cursor memory.

FIG. 6 illustrates in greater detail the structure and operation of the X-comparator circuit 44 and the cursor output circuit 42. The illustrated embodiment uses 4:1 multiplexing of pixel data which means that the circuitry processes four pixels worth of data at a time thereby reducing the required speed of the circuitry to one fourth the actual pixel rate. This permits the use of slower, less expensive technologies. Moreover, the interchip transit times for signals do not present as serious a limitation as they do when trying to process the data at the standard pixel rate. Of course, the invention is not meant to be limited by this choice. Other multiplexing ratios can be selected based upon implementation requirements and they certainly fall within the scope of this invention.

To facilitate the 4:1 multiplexing, the nibble clock 33 described in connection with FIG. 2 actually has a clock rate which is one fourth the pixel rate. Thus, the X-counter 28 generates a count signal $X_{pixel}$ which increments by steps of four.

As illustrated in FIG. 6, the X-comparator 44 includes an x-register 100 which receives and stores the x-location of the cursor, namely $X_{cursor}$, a comparator 102 which compares the x-location of the pixel to be displayed, namely $X_{pixel}$, with $X_{cursor}$. The comparison is actually done by first ignoring the two least significant bits from both numbers and then detecting when the two resulting numbers are equal. As explained later, the two least significant bits of $X_{pixel}$ are utilized elsewhere in the circuit to properly align the output. The comparator 102 generates a START signal 106 which is normally low until the comparator 102 detects that the compared signals are equal, at which time the START signal 106 goes high for one clock period of the nibble clock and then returns to its normally low state.

A gate circuit 104, which produces a gate signal 108 and a three bit wide count signal 110, responds to the START signal 106 as follows. At the beginning of a scan line and prior to the START signal 106 going high, the gate circuit 104 holds the gate signal 108 at low and the count signal 110 at zero. When the gate circuit 104 senses the START signal 106 going high, it switches the gate signal 108 to high and begins incrementing the count signal 110 by one each time it receives another clock pulse from the nibble clock 33. After the count signal 110 reaches 7, that is, after all three bits of the count signal 110 are ones, the gate circuit 104 responds to the next clock pulse from the nibble clock 33 by switching the gate signal 108 back to low and by initializing the count signal 110, which involves setting its three bits to zero.

By switching to a high state, the START signal 106 indicates when the raster scan has reached the x-location of the cursor. After that, each clock pulse from the nibble clock 33 signifies that another group of four pixels worth of new data is moving through the circuit. Accordingly, at the occurrence of the eighth clock pulse, 32 pixels (eight blocks of four pixels) will have been processed since the raster scan reached the x-location of the cursor. At that point, the raster scan will have passed beyond the 32-bit wide sprite cursor and the gate signal 108 drops back to low.

The Y-valid signal 74, depending upon its level, either enables or disables the gate circuit 104. If the Y-valid signal 74 is high, the gate circuit 104 is enabled and will respond to the START signal 106 as described above. On the other hand, if the Y-valid signal is low, the gate circuit is disabled and will not respond to the transition of the START signal 106 from low to high. That is, the gate signal 108 will remain low and count signal 110 will remain at zero for that scan line.

The output of the gate circuit 104 determines how the cursor output circuit 42 processes the two groups of 32 bits of cursor information from the cursor memory 22. The cursor output circuit 42 comprises a cursor data multiplexer 112 which receives the 32 bits of data from a selected row of the cursor memory 22, an X-extender circuit 114 which determines whether the left and right extension functions are activated, and a cursor output multiplexer 116 which receives output signals 112*a* from the cursor data multiplexer 112 and an output signal 114*a* from the X-extender circuit 114.

At this point, it should be noted that FIG. 5 illustrates only the portion of the circuit which processes data from one of the two planes 22*a* and 22*b* of the cursor memory 22. (See FIG. 2) The circuitry for the data coming from the other plane is essentially the same.

As shown in FIG. 6, the output signal 112*a* from the cursor data multiplexer 112 occupies four lines, one for each of the four pixels which are being simultaneously handled by the circuit. In addition, the data multiplexer 112 has eight inputs 118*a–h*, each of which also includes four lines, giving the data multiplexer 112 a total of 32 lines for receiving input signals. The data multiplexer 112 receives the output 23*a* of the cursor memory 22 (refer to FIG. 2) so that each of the 32 lines receives the data from a corresponding location in a selected row of the cursor memory 22. The data multiplexer 112 responds to the count signal 110 from the gate circuit 104 by sequentially selecting one of the input 118*a–h* to provide the output signal 112*a* of the data multiplexer 112. Thus, for example, a count signal 110 of zero (i.e. 0 0 0) causes the data multiplexer 112 to select the input 118*a* corresponding to the first group of four pixels stored in the selected row of cursor memory 22. Then, as the count signal 110 increments by one, this causes the data multiplexer 112 to select the next input 118*b*, corresponding to the next group of four pixels stored in the selected row of cursor memory 22. This continues until the count signal 110 equals 7, corresponding to the last group of four pixels stored in the selected row of cursor memory 22. On the next scan line, the process repeats.

The X-extender circuit 114 establishes whether the left and right extension functions are activated and generates signals which determine the output of the cursor output multiplexer 116 when pixels to the left or the right of the sprite cursor are being displayed. The X-extender circuit 114 has a BIT0 input 120 which receives the first data bit in the selected row of cursor memory 22, a BIT31 input 122 which receives the last data bit in the selected row of cursor memory 22, an HL_LEFT input 124 and an HL_RIGHT input 126. The signal on the HL_LEFT input 124 is either high or low, causing the left extension function to be either activated or not activated, respectively. Similarly, the signal on the HL_RIGHT input 126 is also either high or low, causing the right extension function to be either activated or not activated, respectively.

Figure 7:
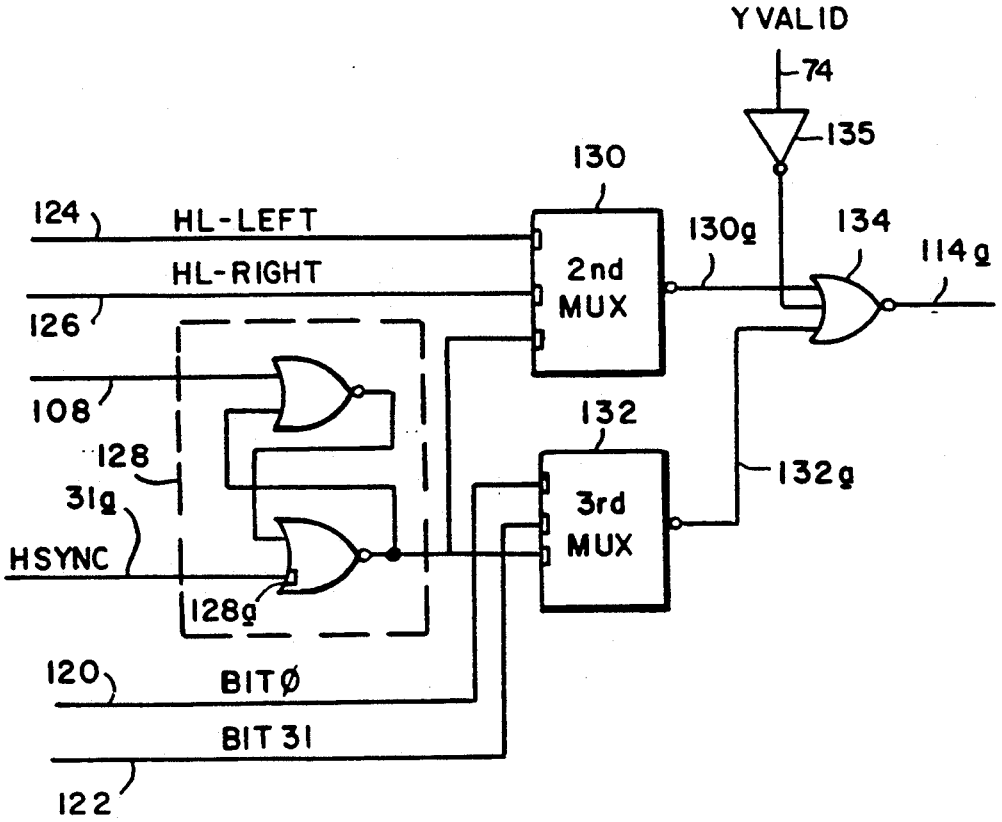
FIG. 7 is a block diagram of the X-extender circuit shown in FIG. 6.

The gate signal 108 causes the X-extender circuit 114 to select either the signals appearing on the HL_LEFT input 124 and the BIT0 input 120 or the signals appearing on the HL_RIGHT input 126 and the BIT31 input 122 to generate its output signal 114*a*. As shown in FIG. 7, the X-extender circuit 114 comprises a second flip-flop 128 which monitors the gate signal 108, a second multiplexer 130 and a third multiplexer 132 which are both controlled by the output of the second flip-flop 128, and a NOR gate 134. The HL_LEFT input 124 and the HL_RIGHT input 126 provide input signals to the second multiplexer 130. Whereas, the BIT0 input 120 and the BIT31 input 122 provide input signals to the third multiplexer 132. Both multiplexers 130 and 132 generate output signals 130*a* and 132*a*, each of which is the complement of the corresponding signal appearing on the selected input. The output signals 130*a* and 132*b* pass to the NOR gate 134 which generates the X-extender output signal 114*a*.

The X-extender circuit 114 also includes a third inverter 135 which receives the Y-valid signal 74 and sends the inverted signal to the NOR gate 134. Depending upon the level of the Y-valid signal 74, it either disables or enables the X-extender circuit 114. If the Y-valid signal 74 is low, it disables the circuit and the output signal 114*a* is low, regardless of the value of any other inputs to the X-extender circuit 114. On the other hand, if the Y-valid signal 74 is high, it enables the circuit and the output signal 114*a* depends upon the input signals in the following way.

At the beginning of a scan line and before the raster scan reaches the x-location of the sprite cursor (i.e. $X_{cursor}$), the gate signal 108 is low and the output of the second flip-flop 128 is low. Consequently, the output 130*a* of the second multiplexer 130 is the complement of the signal appearing on the HL_LEFT input 124 and the output 132*a* of the third multiplexer 132 is the complement of the signal appearing on the BITO input 120. If the signal on the HL_LEFT input 124 is high, the X-extender output signal 114*a* is equal to the signal on the BIT0 input 120. Whereas, if the signal appearing on the HL_LEFT input 124 is low, the X-extender output signal 114*a* will be low. When the gate signal 108 goes high, signaling that the raster scan has reached the x-location of the cursor, the second flip-flop 128 changes state and generates an output which is also high. The second multiplexer 130 and the third multiplexer 132 now select signals appearing on the HL_RIGHT input 126 and the BIT31 input 122, respectively. Thus, if the signal on the HL_RIGHT input 126 is high, the X-extender output signal 114*a* will be equal to the signal on the BIT31 input 122. Whereas, if the signal appearing on the HL_RIGHT input 126 is low, the X-extender output signal 114*a* will be low. The second flip-flop 128 remains in the changed state, regardless of subsequent changes in the gate signal 108, until a reset input 128*a* of the flip-flop 128 receives the HSYNC pulse, indicating that the raster scan is about to begin a new scan line.

The cursor output multiplexer 116 has two inputs 116*a* and 116*b*, each having four lines, one for each pixel being processed, and an output 116*c*, also having four lines. The four lines of the input 116*a* each receive the X-extender output signal 114*a*. The other four, lines of the input 116*b* receive the corresponding out signal 112*a* from the cursor data multiplexer 112. The signal which appears on the four lines of the output 116*c* of the multiplexer 116 is controlled by the gate signal 108. When the gate signal 108 is low, the multiplexer 116 selects the X-extender output signal 114*a*; whereas, when the gate signal 108 is high, the multiplexer 116 selects the output signals 112*a* coming from the cursor data multiplexer 112.

Since the above-described circuit counts and processes pixels in groups of four, the signals on the output 116*c* of the cursor output multiplexer 116 may not be properly aligned with the image data being sent to the display 4. This will happen if the x-location of the cursor does not fall on a four bit boundary, meaning that $X_{cursor}$ is not an integer multiple of four. The x-location of the cursor may be offset from the four-bit boundary by one, two or three pixels. If the offset is not taken into account, the cursor may appear displaced from its intended location on the display by an amount equaling the offset. To prevent the cursor from appearing in the wrong place on the display, the cursor output circuit 42 includes a barrel shifter 136, which is well known to those skilled in the art. The barrel shifter 136 stores the data for the last three pixels of the proceeding clock cycle of the nibble clock. Then, if $X_{cursor}$ does not fall on a four bit boundary, the barrel shifter 136 accounts for this by shifting pixel data forward into the next clock cycle by one, two or three pixels, depending on the offset. Since the amount of offset is precisely specified by the two least significant bits of the 12-bit word specifying $X_{cursor}$, those two bits are sent to an offset control input 136*a* of the barrel shifter 136. In response to the signal SF0, SF1 sent to the offset control input 136*a*, the barrel shifter 136 then generates a four-pixel, time-shifted signal 138 which is properly aligned with the image pixel data.

The time-shifted signal 138 and the corresponding cursor clip signal 56 are then combined in a 4-channel AND circuit 140 to generate the 4-pixel cursor output signal 42*a*. Both the time-shifted signal 138 and the cursor clip signal 56 represent a group of four pixels. For each of the four pixels represented by the signals, the 4-channel AND circuit 140 functions like a gate. That is, when the cursor clip signal 56 indicates that a cursor can appear at a pixel location, the AND circuit 140 passes the corresponding information contained in the time-shifted signal 138. On the other hand, when the cursor clip signal 56 indicates that a cursor cannot appear at a pixel location, the AND circuit 140 sets the output signal 42*a* for that pixel to the value corresponding to transparent mode, i.e. zero.

It should be noted that only the circuitry which process the information from one plane of the cursor memory has been described. Circuitry, which is basically identical to the described circuitry, is also used to process the information from the other plane of the cursor memory thereby generating the other 4-pixel output signal 42*b* shown in FIG. 6.

To simplify the description and to aid in achieving clarity, some elements and features which are obvious to those skilled in the art have been omitted from the description. For example, generally only primary signal paths have been described and some signal paths relating to timing and clock pulses have been omitted. One skilled in the art will readily appreciate that the digital circuits require timing signals to control the movement of data through the circuits.

In addition, since the time it takes for a signal to move through the different sub-circuits within the cursor control circuit may differ depending upon the function and complexity of sub-circuit, it may be necessary to include delay elements in the sub-circuits so as to maintain proper synchronization of the described signals and to achieve alignment of the cursor signal with both the pixel information coming from the frame buffer and the display addressing by the raster scan generator. Such delay elements have not been illustrated since their use is well known to those persons of ordinary skill in the art.

Having thus described illustrative embodiments of the invention, it will be apparent that various alterations, modifications and improvements will readily occur to those skilled in the art. For example, although only specific implementations of some of the described logic functions have been illustrated, other implementations are obvious to persons skilled in the art. Such obvious alterations, modifications and improvements, though not expressly described above, are nonetheless intended to be implied and are within the spirit and scope of the invention. Accordingly, the foregoing discussion is intended to be illustrative only, and not limiting; the invention is limited and defined only by the following claims and equivalents thereto.

What is claimed as new and desired to be secured by Letters Patent of the United States is:

1. A circuit for generating a sprite cursor with edge extension to be displayed on a video display on which an image is generated by scanning information onto the display to produce a vertical array of horizontal scan lines comprising a sequence of pixels each of which is identified by a line number of the scan line, Yscan, and its location on the scan line, Xpixel, wherein said sprite cursor is an N×M array of pixels which is generated by selecting a preselected signal to replace an image signal coming from a frame buffer for the appropriate pixels so that the sprite cursor appears at its desired location on the display, Scursor, Ycursor, said circuit comprising:

A. a cursor memory for storing an N×M array of sprite cursor data which determines the appearance of the sprite cursor;

B. a first counter for identifying the Yscan for the pixel to be displayed;

C. first comparison means responsive to the first counter for comparing the Yscan of the pixel to be displayed with the Ycursor for the cursor;

D. a decoder responsive to the first comparison means for generating a first output addressing a row of the cursor memory, wherein said first output addresses (i) the first row when, Yscan is less than Ycursor (ii) the row intersected by Yscan when Yscan is between Ycursor and Ycursor plus (N−1), inclusive, and (iii) the last row when Yscan is greater than Ycursor plus (N−1);

E. a second counter for identifying the Xpixel of the pixel to be displayed;

F. second comparison means responsive to the second counter for comparing the Xpixel of the pixel to be displayed to the Xcursor for the cursor;

G. cursor output means responsive to the second comparison means for generating a cursor signal which controls the selection of the preselected signal, wherein the cursor output means receives the stored contents of the addressed row from the cursor memory and when the scan line is between Ycursor and Ycursor plus (N−1), inclusive, and Xpixel is between Xcursor and Xcursor plus (M−1), inclusive, the cursor output means generates the cursor signal for each pixel from the stored cursor data in the corresponding location of the addressed row of cursor memory;

H. Y-extender means for causing the cursor output means to generate the cursor signal based upon the stored data in a first preselected row of the cursor memory when Yscan is less than Ycursor, and based upon the stored data in a second preselected row of the cursor memory when Yscan is greater than Ycursor plus (N−1); and I. X-extender means for causing the cursor output means to generate the cursor signal based upon the stored data in a first preselected column of the cursor memory when Xpixel is less than Xcursor, and based upon the stored data in a second preselected column of the cursor memory when Xpixel is greater than Xcursor plus (M−1).

2. A circuit for generating a sprite cursor with edge extension to be displayed on a video display on which an image is generated by scanning information onto the display to produce a vertical array of horizontal scan lines comprising a sequence of pixels each of which is identified by a line number of the scan line, Yscan, and its location on the scan line, Xpixel, wherein said sprite cursor is an N×M array of pixels which is generated by selecting a preselected signal to replace an image signal coming from a frame buffer for the appropriate pixels so that the sprite cursor appears at its desired location on the display, Xcursor, Ycursor, said circuit comprising:

A. a cursor memory for storing an N×M array of sprite cursor data which determines the appearance of the sprite cursor;

B. a first counter for identifying the Yscan for the pixel to be displayed;

C. first comparison means responsive to the first counter for comparing the Yscan of the pixel to be displayed with the Ycursor for the cursor;

D. a decoder responsive to the first comparison means for generating a first output addressing a row of the cursor memory, wherein said first output addresses (i) the first row when, Yscan is less than Ycursor (ii) the row intersected by Yscan when Yscan is between Ycursor and Ycursor plus (N−1), inclusive, and (iii) the last row when Yscan is greater than Ycursor plus (N−1);

E. a second counter for identifying the Xpixel of the pixel to be displayed;

F. second comparison means responsive to the second counter for comparing the Xpixel of the pixel to be displayed to the Xcursor for the cursor;

G. cursor output means responsive to the second comparison means for generating a cursor signal which controls the selection of the preselected signal, wherein the cursor output means receives the stored contents of the addressed row from the cursor memory and when the scan line is between Ycursor and Ycursor plus (N−1), inclusive, and Xpixel is between Xcursor and Xcursor plus (M−1), inclusive, the cursor output means generates the cursor signal for each pixel from the stored cursor data in the corresponding location of the addressed row of cursor memory;

3. A circuit for generating a sprite cursor with edges extendable to a plurality of boundaries of a video display, an image being generated on the display by scanning information onto the display to produce a vertical array of horizontal scan lines comprising a sequence of pixels each of which being identified by a line number of the scan line, Yscan, and its location on the scan line, Xpixel, wherein said sprite cursor is an N×M array of pixels which is generated by selecting a preselected signal to replace an image signal coming from a frame buffer for the appropriate pixels so that the sprite cursor appears at its desired location on the display, Xcursor, Ycursor, said circuit comprising:

A. a cursor memory for storing an N×M array of sprite cursor data which determines the appearance of the sprite cursor;

B. means for generating a cursor signal from the sprite cursor data stored in the cursor memory such that, for each scan line between Ycursor and Ycursor plus (N−1), inclusive, and for each pixel on the scan line between Xcursor and Xcursor plus (M−1), inclusive, said generating means generates the cursor signal for each pixel form the cursor data stored in the corresponding location of the cursor memory and wherein said cursor signal controls the selection of the preselected signal; and c. control means for causing the displayed cursor to comprise a pair of intersecting elements, said control means comprising Y-extender means which controls the generating means so as to extend the top and bottom rows of the sprite cursor in the corresponding y-directions to corresponding top and bottom boundaries of the video display, and X-extender means which controls the generating means so as to extend the left and right columns of the sprite cursor in the corresponding x-directions to corresponding left and right boundaries of the video display, whereby the sprite cursor is converted to a hairline cursor.

H. Y-extender means for causing the cursor output means to generate the cursor signal based upon the stored data in a first preselected row of the cursor memory when Yscan is less than Ycursor, and based upon the stored data in a second preselected row of the cursor memory when Yscan is greater than Ycursor plus (N−1); and I. X-extender means for causing the cursor output means to generate the cursor signal based upon the stored data in a first preselected column of the cursor memory when Xpixel is less than Xcursor, and based upon the stored data in a second preselected column of the cursor memory when Xpixel is greater than Xcursor plus (M−1), said Y-extender means and said X-extender means operable to form a cursor having intersecting elements, whereby a hairline cursor is formed.

4. A circuit for generating a sprite cursor as defined in claim 3, further comprising:

A. first means for providing information defining a plurality of boundaries of each of a plurality of windows to be displayed simultaneously on the video display;

B. second means for providing a cursor clip flag for each window for indicating whether a cursor can appear in the corresponding window; and C. cursor clipping means for causing the displayed cursor including the intersecting elements or any portion thereof to appear in only selected ones of the displayed windows by generating a cursor clip signal for controlling the cursor generating means, said cursor clip signal indicating whether the preselected signal can be sent to the pixel to be displayed, and wherein said cursor clipping means receives the boundary information from the first means to determine which window owns the pixel and receives the the cursor clip flag from the second means to determine whether the cursor clip flag corresponding to the owning window will permit a cursor signal to be sent to the pixel, whereby the generated cursor, including the intersecting elements, as displayed on the video display will appear in selected ones of the windows and not in others of the windows.

5. A circuit for generating a sprite cursor as defined in claim 3, wherein (i) the y-extender means reproduces the pattern in the rows of the sprite cursor at Ycursor and Ycursor plus (N−1) on each scan line located respectively above and below the sprite cursor, and (ii) the x-extender means reproduces the pattern in the columns of the sprite cursor at Xcursor and Xcursor plus (M−1) on the scan lines respectively to the left and to the right of the sprite cursor.

6. A cursor control circuit for clipping a cursor having a central portion and extension portions so that the cursor will appear on a video displayed image simultaneously within and extending across selected windows of a plurality of windows and not appear in others of the plurality of windows, wherein the image comprises an array of pixels and each window of the plurality of windows is defined by a corresponding set of boundaries within the array of pixels, and wherein the cursor is generated by sending a reselected signal to the display in place of an image signal from a frame buffer, said circuit comprising:

A. first means for providing information defining the boundaries of the plurality of windows to appear on the display;

B. second means for storing information comprising a cursor clip flag for indicating the identity of all the windows in which the cursor portions can appear; and C. cursor clipping means for causing the displayed cursor to appear simultaneously in the windows identified by the cursor clip flag, by generating a cursor clip signal which indicates whether the preselected signal can be sent to the pixel to be displayed, wherein said cursor clipping means uses the boundary information from the first means in determining which window owns the pixel and uses the information stored in the second means in determining whether the cursor clip flag corresponding to the owning window will permit a cursor signal to be sent to the pixel, whereby the cursor will appear simultaneously only within selected windows indicated by the cursor clip flags.

7. A cursor control circuit as defined in claim 6, wherein the cursor clipping means comprises:

A. over-lapping window detector logic for generating a detection signal identifying each of the windows having boundaries which contain the pixel and conveying the information contained in the cursor clip flags for each of the identified windows; and B. a priority tree circuit which responds to the detection signal by selecting the owning window from the identified windows and by setting the cursor clip signal in accordance with the cursor clip flag information corresponding to the owning window.

8. A video workstation comprising:

A. a video display on which a signal is scanned to produce a vertical array of horizontal scan lines comprising a sequence of pixels, each of which is identified by a line number of the scan line, Yscan, and its location on the scan line, Xpixel, said video display having top, bottom, left and right boundaries;

B. a frame buffer which stores image data used to produce an image signal;

C. an input device which controls the location of a sprite cursor appearing on the video display, wherein the sprite cursor appears as an N by M array of pixels and is generated by selecting for each corresponding pixel location on the display a preselected signal to replace the image signal so as to produce the sprite cursor at the desired location;

D. a cursor memory for storing an N×M array of sprite cursor data which determines the appearance of the sprite cursor;

E. means for generating a cursor signal from the sprite cursor data stored in the cursor memory such that for each scan line between Ycursor and Ycursor plus (N-1), inclusive, and for each pixel on the scan line between Xcursor and Xcursor plus (M−1), inclusive, said generating means generates the cursor signal for each pixel from the cursor data stored in the corresponding location of the cursor memory, and wherein said cursor signal controls the selection of the preselected signal;

F. extender means for causing the shape of the displayed cursor to comprise a pair of intersecting elements, said extender means comprising Y-extender means which controls the generating means so as to extend the top and bottom rows of the sprite cursor in the corresponding y-directions to the top and bottom boundaries of the display; and X-extender means which controls the generating means so as to extend the left and right columns of the sprite cursor in the corresponding x-directions to the left and right boundaries of the display, whereby a hairline cursor is formed.

9. A video workstation as defined in claim 8, further

A. a first register for storing information defining the boundaries of a plurality of windows;

B. a second register for storing a cursor clip flag for each window for indicating whether a cursor may appear in the corresponding window; and C. cursor clipping means for generating a cursor clip signal which controls the cursor generating means and the extender means, wherein the cursor clip signal indicates whether the preselected signal can be sent to the pixel to be displayed, and wherein said cursor clipping means receives the boundary information from the first register to determine which window owns the pixel and receives the information stored in the second register to determine whether the cursor clip flag corresponding to the owning window will permit a cursor signal to be sent to the pixel, the cursor clipping means comprising (i) overlapping-window detector logic which generates a detection signal identifying each of the windows having boundaries which contain the pixel and conveying the information contained in the cursor clip flags for each of the identified windows; and (ii) a priority tree circuit which responds to the detection signal by selecting the owning window from the identified windows and by setting the cursor clip signal in accordance with the cursor clip flag corresponding to the owning window.

10. A circuit for generating a sprite cursor with edge extension on a video display on which an image is generated within a window by scanning information onto the display to produce a vertical array of horizontal scan lines comprising a sequence of pixels each of which is identified by a line number of the scan line, Yscan, and its location on the scan line, Xpixel, wherein said sprite cursor is an N×M array of pixels which is generated by selecting a preselected signal to replace an image signal coming from a frame buffer for the appropriate pixels so that the sprite cursor appears at its desired location on the display, Xcursor, Ycursor, said circuit comprising:

A. a cursor memory for storing an N×M array of sprite cursor data which determines the appearance of the sprite cursor;

B. means for generating a cursor signal from the sprite cursor data stored in the cursor memory such that, for each scan line between Ycursor and Ycursor plus (N−1), inclusive, and for each pixel on the scan line between Xcursor and Xcursor plus (M−1), inclusive, said generating means generates the cursor signal for each pixel form the cursor data stored in the corresponding location of the cursor memory and wherein said cursor signal controls the selection of the preselected signal;

C. Y-extender means for controlling the generating means so as to extend the top and bottom rows of the sprite cursor across the window in the corresponding y-directions; and D. X-extender means for controlling the generating means so as to extend the left and right columns of the sprite cursor across the window in the corresponding x-directions.

11. A cursor control circuit for clipping a hairline cursor so that the cursor will appear on a video displayed image simultaneously within selected windows of a plurality of windows and not within others of the plurality of windows, wherein the image comprises an array of pixels and each window of the plurality of windows is defined by a corresponding set of boundaries within the array of pixels, and wherein the cursor is generated by sending a preselected signal to the display in place of an image signal from a frame buffer, said circuit comprising:

A. first means for storing information defining a plurality of boundaries of each of the plurality of windows;

B. second means for storing information comprising a cursor clip flag for indicating the identities of all the windows in which the cursor can appear; and C. cursor clipping means for generating a cursor clip signal which indicates whether the preselected signal can be sent to the pixel to be displayed, wherein said cursor clipping means uses the boundary information from the first means to determine which window owns the pixel and uses the information stored in the second means to determine whether the cursor clip flag corresponding to the owning window will permit a cursor signal to be sent to the pixel, whereby the cursor will appear simultaneously within selected windows indicated by the cursor clip flags, the cursor clipping means comprising (i) overlapping-window detector logic for generating a detection signal identifying each of the windows having boundaries which contain the pixel and conveying the information contained in the cursor clip flags for each of the identified windows; and (ii) a priority tree circuit which responds to the detection signal by selecting the owning window from the identified windows and by setting the cursor clip signal in accordance with the cursor clip flag information corresponding to the owning window.

* * * * *